US007367564B2

(12) United States Patent
Latell

(10) Patent No.: US 7,367,564 B2
(45) Date of Patent: May 6, 2008

(54) MATHEMATICS GAME AND METHOD

(76) Inventor: Richard Latell, 425 Westchester Dr., SE., Warren, OH (US) 44484

( * ) Notice: Subject to any disclaimer, the term of this patent is extended or adjusted under 35 U.S.C. 154(b) by 264 days.

(21) Appl. No.: 11/036,566

(22) Filed: Jan. 14, 2005

(65) Prior Publication Data

US 2006/0157932 A1 Jul. 20, 2006

(51) Int. Cl.

| | |
|---|---|
| ***A63F 3/00*** | (2006.01) |
| ***A63F 1/00*** | (2006.01) |
| ***G09B 19/02*** | (2006.01) |
| ***G09B 19/22*** | (2006.01) |

(52) U.S. Cl. ..... 273/299; 273/272; 434/129; 434/188

(58) Field of Classification Search ..... 273/272, 273/299, 302, 429; 434/129, 188, 191
See application file for complete search history.

(56) References Cited

U.S. PATENT DOCUMENTS

| | | | | |
|---|---|---|---|---|
| 2,811,360 | A * | 10/1957 | Cohen | 273/272 |
| 3,267,590 | A * | 8/1966 | Browning | 273/272 |
| 3,744,153 | A * | 7/1973 | Van Es | 273/272 |
| 3,904,207 | A * | 9/1975 | Gold | 273/272 |
| 4,281,835 | A * | 8/1981 | Seiden | 273/299 |
| 4,776,597 | A * | 10/1988 | Rudell | 273/241 |
| 4,808,111 | A * | 2/1989 | Pratt | 434/191 |
| 5,338,203 | A * | 8/1994 | Rheams | 434/208 |
| 5,529,497 | A * | 6/1996 | Bigold | 434/191 |
| 5,868,393 | A * | 2/1999 | Williams | 273/299 |
| 6,581,937 | B1 * | 6/2003 | Crisswell | 273/299 |
| 6,685,189 | B2 * | 2/2004 | Cherven | 273/304 |
| 7,083,169 | B2 * | 8/2006 | Collins | 273/292 |

OTHER PUBLICATIONS

"How to Play UNO" Mattel, Inc., 1992, pp. 1-3.*
"The golden rule game" game rules, pp. 1-2.*
Number Jugglers: Math Card Games, 1998-2007, alibris, pp. 1-3. <http://www.alibris.com/search/search.cfm>.*
"Equate" Math Game at http://www.conceptualmathmedia.com/equate/howtoplay.asp.
"Snap It Up! Math"—game rules at http://www.educational-learninggames.com/how-to-play-snap-it-up-math-addition-subtraction-game-rules.asp
"1-2-3 Oy!" http://www.usillygoose.com/123oy.html.
General Rules for "The Golden Rule Game".

* cited by examiner

*Primary Examiner*—Eugene Kim
*Assistant Examiner*—Alyssa M Hylinski
(74) *Attorney, Agent, or Firm*—Renner, Kenner, Greive, Bobak, Taylor & Weber

(57) ABSTRACT

A method for playing a mathematics game includes the steps of providing playing cards including a plurality of numeric cards, at least one operational card, and at least one equal sign card; constructing a numeric sentence framework; dealing a select number of the plurality of numeric cards to a select number of players to provide each player with a hand of numeric cards; and creating a first true numeric sentence by playing into the numeric sentence framework at least one or more of the numeric cards in a player's hand.

20 Claims, 1 Drawing Sheet

MATHEMATICS GAME AND METHOD

RELATED PATENT APPLICATIONS

None.

FIELD OF THE INVENTION

The present invention generally relates to a mathematics card game, and, more particularly, relates to a method for playing a mathematics game wherein numeric cards are played from a player's hand into a numeric sentence framework.

BACKGROUND OF THE INVENTION

When educating someone, it is common to employ an education method that makes the learning experience feel like a game. Educational methods that resemble games are particularly more attractive to children, who tend to find more traditional forms of education, such as rote memorization and replication, to be boring. This is particularly true when it comes to learning mathematics.

There is no avoiding the fact that the foundations for learning mathematics must rest upon the rote memorization of addition, subtraction, multiplication, and division "tables." These "tables" typically provide the values for the addition, subtraction, multiplication, and division of all the various combinations of the integers from zero to nine. Once all of the various combinations of these integers are memorized by an individual, the learning of more advanced mathematics is possible. However, memorizing each different mathematical combination of the integers zero through nine requires constantly working with arithmetic combinations of such integers until the value of a given arithmetic combination is immediately brought to mind upon being presented with the combination. For example, it is necessary that someone should be able to state that $9\times6=54$, without having to count by groups of nines or sixes. Rather, to advance in mathematics, it is necessary that the answer to such an arithmetic combination "$6\times9$" simply be "known." Thus, although methods do exist in the prior art for aiding in the memorization of arithmetic principles, there is always a need in the art for additional education methods that make such learning enjoyable, such that adequate time will be devoted to such principles, for the purpose of strengthening math skills. In addition, there is always a need for an enjoyable family game at home that brings families together in a shared activity of fun and relaxation.

SUMMARY OF THE INVENTION

In light of the foregoing, the present invention serves to provide a method for playing a mathematics game. The method for playing a mathematics game includes the steps of providing playing cards including a plurality of numeric cards, at least one operational card, and at least one equal sign card; constructing a numeric sentence framework; dealing a select number of the plurality of numeric cards to a select number of players to provide each player with a hand of numeric cards; and creating a first true numeric sentence by playing into the numeric sentence framework at least one or more of the numeric cards in a player's hand.

The method for playing a mathematics game according to this invention may be practiced by one or more players. Thus, in multi-player embodiments, after said step of creating a first true numeric sentence, each player takes turns playing at least one or more numeric cards from their respective hand into the numeric sentence framework provided by a directly preceding player, in order to create a subsequent true numeric sentence. On each player's turn, the number of numeric cards in that player's hand may be increased by drawing one or more numeric cards from the draw pile, and, on each turn, a player plays numeric cards onto empty spaces in the numeric sentence framework or plays numeric cards on top of previously played numeric cards or both, such that stacks of cards may be created within the numeric sentence framework.

If at any time the draw pile is exhausted, i.e., no cards remain in the draw pile, all but the top cards on any stacks of cards within the numeric sentence framework are gathered and reshuffled to create at least a portion of a new draw pile, while the top cards remain in their respective positions within the numeric sentence framework. In this manner, a player should always be capable of creating a true numeric sentence by playing cards from his/her hand into the numeric sentence framework provided by a directly preceding player.

The method of this invention provides that the math game may be won when a player creates a true numeric sentence using all the cards remaining in the player's hand, but, in other embodiments, the next player can prevent the preceding player from winning by creating a subsequent true numeric sentence by playing at least one or more cards from said next player's hand, wherein the cards in said next player's hand may be increased by drawing up to a select number of cards from the draw pile.

The method of the present invention may be practiced with addition, subtraction, multiplication or division equations, and equations including a combination of addition, subtraction, multiplication and division operators, and may be practiced with a number of alternative rules and procedures. Algebra and fractions may also be practiced according to specific embodiments. The specifics of the present method and alternatives will become more apparent from the description that follows.

Figure 1:
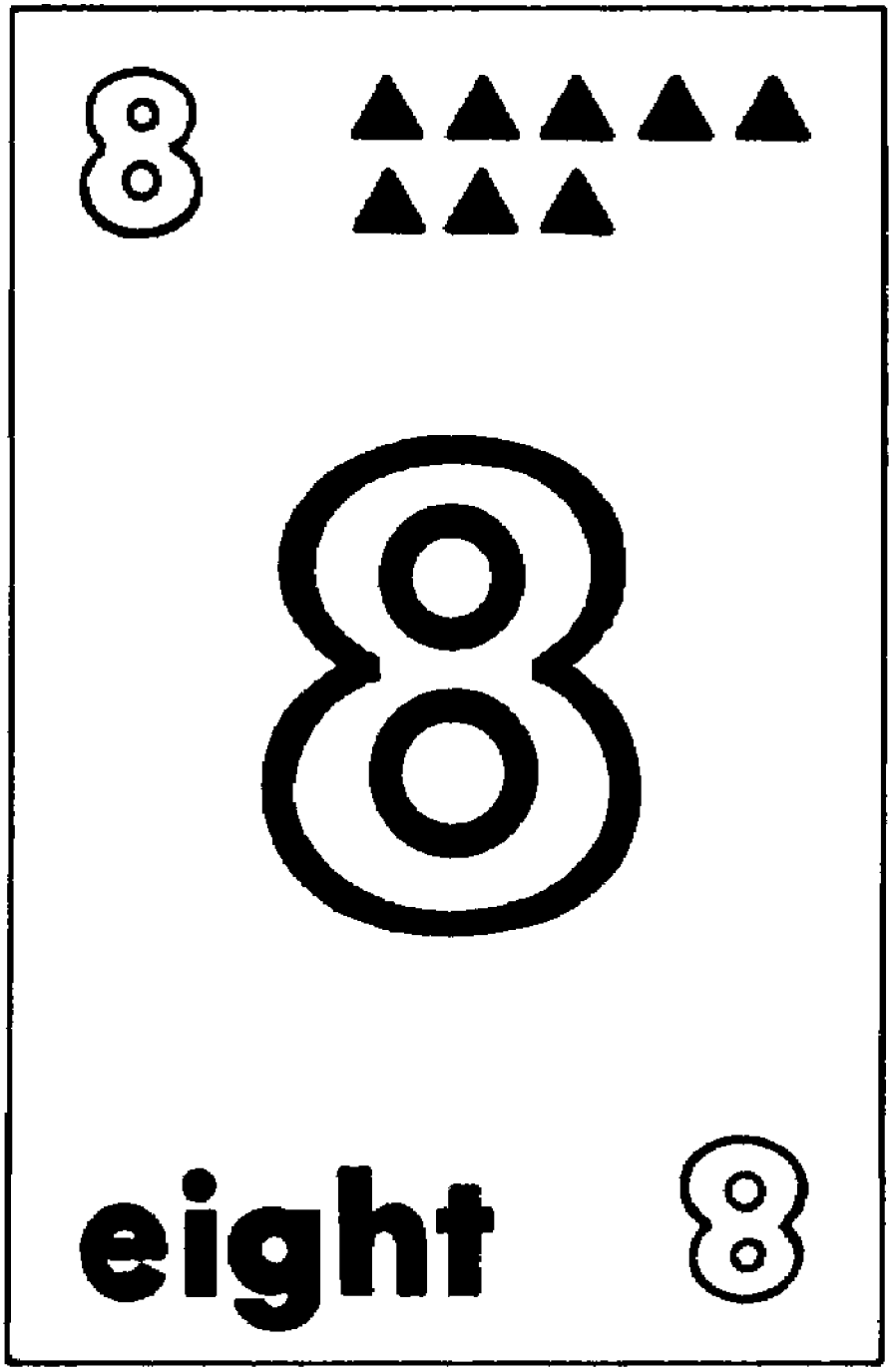
FIG. 1 shows the front of a numeric "8" card according to the card game of this invention.

In addition to FIG. 1, reference is made herein to tables that show examples of game play according to the various embodiments of this invention. For ease of reference, the tables are provided at the end of the disclosure, rather than embedded in the text to follow. The tables are labeled to help identify the aspects of the invention that the examples within the tables are to help exemplify.

BRIEF DESCRIPTION OF THE PREFERRED EMBODIMENTS

In one embodiment, the present invention provides a mathematics card game, wherein it is the goal of each player to get rid of all of the cards held in his or her hand by playing them into a numeric sentence framework. Various methods for practicing the game of the present invention will become apparent from the following disclosure of the game's physical makeup and its rules and procedures.

The physical components of the card game, in its most basic form, include a plurality of numeric cards. In the plurality of numeric cards, each individual numeric card bears a single integer designation ranging from zero to nine, and, although integers are preferred, fractions and real numbers might also be employed. In particular embodiments of the game, "wild cards" and "fish" cards may also be provided. Of the plurality of numeric cards, and any alternative cards, a select number are dealt to each player, after shuffling, while the remainder forms a draw pile.

A numeric sentence framework is provided to play the game. It may be provided simply by providing blank spaces separated, at appropriate positions, by at least one math operation and at least one equal sign, with the blank spaces being provided to receive numeric cards. In preferred embodiments, at least one operational card and at least one equal sign card are provided as part of the card game, and are employed to provide a numeric sentence framework, which may be considered to be the playing surface of the math game, whether provided by cards or otherwise. As an alternative to the provision of a numeric sentence framework through operational and equal sign cards, a writing implement may be used to simply draw the framework. Other physical components beneficial for specific embodiments of the basic card game may include fraction lines, a variable X card, a deck of fraction cards, parentheses signs and bracket signs.

For reasons that should be apparent after gaining a thorough understanding of the rules, there need not be provided an equal number of each integer, zero through nine, of the plurality of numeric cards. Rather, there may be provided more cards of one particular integer as compared to the number of cards of another integer. Although the distribution of the plurality of numeric cards as to each integer will affect game play, the present invention is not to be limited to any particular distribution and not to be limited to any particular total number of cards in the deck. However, in the interest of disclosing what is believed to be a preferred distribution of the plurality of numeric cards, the following distributions are provided, one for addition and subtraction games, and one for multiplication and division games.

In addition and subtraction games, the distribution of the plurality of numeric cards is as follows: three 0's, four 1's, five 2's, five 3's, five 4's, five 5's, five 6's, five 7's, five 8's and five 9's; and, for multiplication and division games according to this invention; two 0's, five 1's, ten 2's, seven 3's, ten 4's, seven 5's, seven 6's, five 7's, seven 8's, and five 9's. Finally, although more or less may be used without departing from the math game taught herein, only one "wild card" and one "fish card" is employed in preferred embodiments. Beneficial numeric card distributions may be theoretically and experimentally determined, and may be different for different types of games according to this invention.

As indicated, in preferred embodiments, one set of numeric cards is provided for addition and subtraction games, while a different set of numeric cards is provided for multiplication and division games. Likewise, at least four different operational cards are provided, including at least one addition sign card, at least one subtraction sign card, at least one multiplication sign card, and at least one division sign card. It is noted that "at least one" of each of these operational cards is provided inasmuch as at least one of each card is needed to play the four different types of basic math games disclosed herein, namely, an addition math game, a subtraction math game, a multiplication math game, and a division math game. Also, it is noted that "at least one" of each operational card is provided inasmuch as it is advisable to provide more than one of each operational card to either make provision for lost cards or to allow players to create numeric sentence frameworks that are more complex than the basic numeric sentence frameworks that will be particularly discussed herein in disclosing the present math game.

A "numeric sentence framework" consists of at least one operational card and at least one equal sign card, although more than one operational card and more than one equal sign card may be employed to create a more complex numeric sentence framework. The numeric sentence framework is created according to the desires of the players, and basically forms the playing surface for the math game. Creating the numeric sentence framework is the first step in setting up the math game to begin play. Blank spaces are provided on either side of the operational card or cards and at a position opposite the equal sign card or cards, such that integers from the plurality of numeric cards can be played into these blank spaces, from a player's hand, to create a true numeric sentence. Alternatively, one or more numeric cards might form a portion of the numeric sentence framework, and may remain a constant for that game, so long as at least one blank space is provided to a low the first player an attempt to correctly complete the numeric sentence. The following examples should serve to help define what is meant by "numeric sentence framework" with the understanding that these examples are non-limiting, and more complex numeric sentence frameworks might be provided.

In the following examples, the operation symbols (+, −, ×, ÷) and the equal sign (=) represent operational cards and equal sign cards respectively, while the multiple blank lines represent potential placement positions for numeric cards that would be played from a player's hand. In a very basic addition game, the numeric sentence framework is created as follows: _____+_____=_____; and for more advanced addition games, would be provided as follows: _____+_____=_____ _____, such that double-digit sums could be created by playing numeric cards into the numeric sentence framework. In a basic subtraction game, the numeric sentence framework would be provided as follows: _____−_____=_____, wherein there is provided a single-digit minuend; and, for a more advanced subtraction game the numeric sentence framework _____ _____−_____=_____ could be constructed, such that provision is made for double-digit minuends. For multiplication, a numeric sentence framework would be: _____×_____=_____ _____(double-digit product), or _____×_____=_____ (single digit product). For division: _____ _____÷_____=_____ (double-digit dividend), or _____÷_____=_____ (single-digit dividend).

To help broaden the understanding of "numeric sentence framework," the following, more complicated numeric sentence framework is provided, as an example: _____×_____=_____ _____÷_____=_____. Another example might be _____×_____−_____=_____ _____. As mentioned, one or more numeric cards might be included in the initial numeric sentence framework. For example, the numeric sentence framework might be set up as follows: _____+4=_____. The preexistent numeric card in such numeric sentence frameworks (in this case, the 4 card) may be replaced during play by a player's placement of a card on top thereof or, alternatively, may be designated to remain constant such that no player may play a card on top thereof. In a very advanced numeric sentence framework, operational cards need not be constant, as, for example, in _____ [blank] _____ [blank] _____ =9, where the preexisting numeric card (in this case, the 9 card) is constant, and players may choose and play different operational cards to the "[blank]" positions between the spaces designated for the placement of numeric cards. Notably, the more basic numeric sentence frameworks will be focused upon in disclosing the mathematics game of this invention. The general rules will be easily applicable to more complex numeric sentence frameworks. Vertically oriented numeric sentences may also be formed.

The numeric sentence framework may also include fractions. In addition and subtraction games, a denominator is randomly selected from integers from 2-9, and the denominator chosen is selected from the numeric cards and provided in the numeric sentence framework. For example, if it is decided (or randomly chosen) that the numeral 5 is to be the denominator in a fractions addition and subtraction game, the numeric sentence framework might be set up as follows:

$$\frac{_}{5} + \frac{_}{5} = \frac{_}{5}$$

wherein players play their cards to the blank numerator positions. The blank spaces may accept more than one numeric card, i.e., double digits are contemplated as an alternative.

It will be appreciated that more complex fraction numeric sentence frameworks might also be provided. In a fractions multiplication and division game, the numeric sentence framework is to be provided with a multiplicand that is either a finished or unfinished fraction. The multiplier and the product are left blank. Thus, for example, a fractions multiplication and division game might have the following as numeric sentence frameworks where blank spaces are not necessarily limited to a single-digit number:

$$\frac{1}{_} \times _ = _ \text{ or } \frac{4}{7} \times _ = _.$$

The first example equation provides an unfinished multiplicand fraction, with a numerator of 1, while the second example equation provides a finished fraction multiplicand (4/7). In both, the blank spaces indicate where players may play their cards. When a complete fraction is provided as one of the multiplicands, it is envisioned that the following fractions will be the preferred choices, and the card game might be provided with the following fraction cards: 1/2, (2/4, 3/6, 4/8); 1/3(2/6, 3/9); 2/3 (4/6); 1/4 (2/8, 4/8); 3/4 (6/8); 1/5; 2/5; 3/5; 4/5; 1/6; 5/6; 1/7; 2/7; 3/7; 4/7; 5/7; 6/7; 1/8; 3/8; 5/8; 7/8; 1/9; 2/9; 4/9; 5/9; 7/9; and 8/9.

As mentioned in examples above, another type of numeric sentence framework using whole numbers and/or fractions has the answer preset to the right of an equal sign, and one or more operations (or spaces for operations to be selected by players on their turn) to the left of the equal sign. Whereas the preset answer remains constant for the game, cards are played to spaces left of the equal sign, and when added, subtracted, multiplied and/or divided will equal the answer, and complete the numeric sentence.

Yet another type of numeric sentence framework may be provided to practice algebra. In an addition and subtraction algebra game, the numeric sentence framework includes a "variable" card (typically bearing the variable "X" ) that is inserted into the numeric framework. For example, the following numeric sentence frameworks might be provided wherein blank spaces are not necessarily limited to a single-digit number:

$$___ + X = ___;$$

$$X + ___ = ___;$$

$$___ - ___ = X;$$

$$___ - X = ___;$$

$$\frac{_}{3} + \frac{X}{3} = \frac{_}{3}; \text{ and}$$

$$___ + X - ___ = ___.$$

The variable card is likewise used in multiplication and division algebra games, in which, by way of example, the following numeric sentence frameworks might be provided:

$$___ \text{x } X = ___;$$

$$X \text{ x} ___ = ___;$$

$$___ / X = ___;$$

$$___ / ___ = X;$$

$$\frac{_}{7} \times \frac{x}{3} = \frac{_}{21}; \text{ and}$$

$$(___ + ___)x = ___$$

In addition and subtraction algebra games, the sum and minuend may be a one-digit number (0-9) or a two-digit number (10-18), while addends, subtrahends, and differences may be single digit numbers only. In multiplication and division algebra games, the product and dividend may be a one-digit (0-9) or two-digit (10-81) number. Multipliers, multiplicands, quotients, and divisors may be single digit numbers only.

The fractions and algebra games present some peculiarities not encountered in more basic addition and subtraction or multiplication and division games. Thus, preferred rules that are pertinent to the algebra and fraction games will be discussed separately below.

To begin play, a numeric sentence framework is created, and the numeric cards and any wild cards or fish cards, if desired, are shuffled together and a select number dealt to the players. It should be appreciated that, herein, when mention is made of playing a numeric card or drawing a numeric card or dealing a numeric card, the "numeric card" might also be, and therefore encompasses, a wild card or fish card. In a preferred embodiment of this invention, a dealer shuffles the numeric cards (and any wild/fish cards) and, beginning to the left, deals them, one at a time, face down to each player, continuing clockwise until each player has five cards, although more or less cards might be dealt. The remaining cards are placed face down as a draw pile. It is suggested that the game be played with up to four players, with each player being dealt five cards at the beginning of the game, but the present invention does not have to be limited in this manner. Generally, the player left of the dealer will begin game play, although, again, such rules may be modified according to the players' desires.

The player that is to start the game must, on his/her turn, make a true numeric sentence, by playing cards from his/her hand, into the numeric sentence framework. For the first player, the numeric sentence framework will simply have blank areas into which numeric cards may be placed, as indicated above, where exemplary numeric sentence frameworks were disclosed. For subsequent players, the numeric sentence framework will contain stacks of previously played numeric cards or empty spaces (as when cards are discarded or moved as discussed below) or both, and, on each of their respective turns, the subsequent players will play one or more numeric cards from their hands, onto these stacks and/or empty spaces, to create new true numeric sentences, such that all cards in a new numeric sentence are either newly played are a combination of new cards and cards from the previous numeric sentence.

For a much more simplified and introductory, beginner's game, the numeric sentence framework may consist of all operational cards and all but one numeric card necessary for completing the sentence. That is, the numeric sentence framework may be set up to require that only one blank spot needs to be filled in order to create the true numeric sentence. It is envisioned that this type of game would be practiced by parents/teachers and their children/students, because the parent/teacher would be able to present the child/student with specific problems to test his/her math skills. The remainder of the numeric cards would be separated into separate piles, one or each integer, and the child/student would choose the appropriate number from these piles to complete the true numeric sentence. For this simplified version of the game, the separate piles of numeric cards from which the child chooses his/her answers are to be considered a "hand" of numeric cards.

A "true numeric sentence" is simply an accurate expression of an arithmetic function, as, for example, $7+2=9$, $8-3=5$, $3\times8=24$, or $27\div9=3$. When making a true numeric sentence, a player may say the sentence out loud, i.e., "five plus three equals 8." If a player can make more than one true numeric sentence on his/her turn, he/she may choose which true numeric sentence to play. When an incorrect numeric sentence is played, other players should politely say there is a mistake, and, if necessary, politely explain why that player's numeric sentence is incorrect. Thereafter, the player may try again to make a true numeric sentence. Especially when playing the math game of the present invention for the purpose of learning or strengthening arithmetic skills, players may be helped by other players in making numeric sentences, and addition/subtraction or multiplication/division tables may also be used to aid the players.

On the first player's turn, there is no true numeric sentence in play, and, therefore, all of the numeric cards that are used to make the true numeric sentence must come from the first player's hand (unless, as mentioned, one or more numeric cards were used to create the initial numeric sentence framework, in which case, the first player may not have to provide all of the numeric cards forming the true numeric sentence). If a true numeric sentence cannot be created from the numeric cards dealt to the first player, the first player must draw cards, one at a time, from the draw pile, until a true numeric sentence can be created. The examples below are provided to help show what might occur on a first player's turn. In the examples, numeric cards played from a player's hand are underlined, numeric cards already in play are in regular typeface, repositioned numeric cards (to be explained) are designated with an "m" superscript. and, when it is helpful for illustration, the first numeric card underneath the top numeric card in play is shown as a subscript. Table 1 is provided below to provide examples of a first player's turn, wherein the first player can create a true numeric sentence without having to draw cards. Table 2 provides one example in which a first player had to draw two numeric cards from the draw pile before being able to create a true numeric sentence, to thereby end his/her turn.

Once a true numeric sentence has been created by a first player, the next player (typically the player to the first player's left) must create a true numeric sentence by playing cards from his or her hand into the true numeric sentence left by the first player. Now that numeric cards are present within the numeric sentence framework, a player, on his/her turn, will play numeric cards on top of previously played cards, but sometimes to empty spaces as when a card may be removed in accordance with optional rules. In one embodiment of an addition and/or subtraction game, or a multiplication and division game, the sum, minuend, or the product or dividend, as the case may be, is cleared by removing all cards played to the sum/minuend or to the product/dividend answer piles, and other cards in the number sentence to a discard pile (or in an alternative method to card selection piles, at the end of one player's turn and before the next player's turn.

On his turn, a player may use any combination of numeric cards in play (i.e., the top showing numeric cards) and cards played from his/her hand with the condition that at least one card must be newly played. If unable to create a numeric sentence, the player draws from the draw pile until one can be created, or, as an optional rule, if after drawing one card, a numeric sentence still cannot be made, play passes to the next player. A player may also draw from the draw pile for strategic purposes, even if a true numeric sentence could be created by that player. If there are no cards in the draw pile, and the game is not over, all cards played down (except the top cards in play) and all cards in any discard pile are gathered and reshuffled to make a new draw pile. In an optional rule, players may be required to start their turns with at least a select number of numeric cards in their hand. If they have less than the select number, they must, at the beginning of their turn, draw a sufficient number of cards from the draw pile. A preferred minimum number of cards to require in hand is three.

It should be noted that using a numeric card already in play (i.e., a top showing numeric card) takes precedence over playing the same numeric card from a player's hand. This particular rule will be explained more fully below. For now, it should be appreciated that, on his/her turn, a player may either create a new true numeric sentence by employing one or more of the cards in play (top showing numeric cards) along with one or more cards from hand, or may cover up each of the top showing numeric cards with cards from his/her hand. In some embodiments where a preset number is a constant in the numeric sentence framework, cards are not played on top of the constant preset number. Table 3 provides general examples of playing numeric cards onto a true numeric sentence left by a preceding player. Note, in the last example, all of the cards that form the new number sentence are from the cards in hand.

A numeric card may not be played on top of a numeric card of the same integer, may not be discarded and replaced by a same number card nor may it be played on top of a wild card representing the same integer, and a wild card may not be assigned the same number as the card or wild card upon which it is played. However, when a player has two different numeric cards that are the same numbers as (a) the two addends of an addition number sentence, (b) the subtrahend and difference in a subtraction number sentence, (c) the two factors of a multiplication number sentence, or (d) the divisor and quotient in a division number sentence, the two numeric cards in the player's hand may be played in reverse order on top of those two numeric cards in play (i.e., not on top of the same number). This rule is exemplified in Table 4.

When a player has a number card in hand that is the same number as just one of (a) the addends of an addition number sentence, (b) the subtrahend and difference in a subtraction number sentence, (c) the two factors of a multiplication number sentence, or (d) the divisor and quotient in a division number sentence, and only one of these two same number cards is to be used in either of the two positions in a new numeric sentence (and a different number in the other position), the same number card in play takes precedence. This is employed when the same number in hand would be used in place of the number in play. Example, 4+2=6 is in play. A player with 4 and 8 in hand can play the 4 in hand to make $4+\underline{4}_2=\underline{8}_6$. However, a player with 459 could not make $\underline{5}_4+\underline{4}_2=\underline{9}_6$, using the 4 in hand while at the same time playing over the 4 in play. This player could, however, make $4+\underline{5}_2=\underline{9}_6$, the use of the 4 in play taking precedence over using the 4 in hand. This rule also applies to wild cards, once they have been played and designated as an integer. Particularly, a numeric card may not be played on top of a wild card representing the same integer as the numeric card. Further examples are provided in Table 5 and discussed below.

In the first example in Table 5, just one addend, the 5, is in the player's hand, and thus, the addend 5 in play is used, such that the player may not play the 5 from hand to make $\underline{9}_5+\underline{5}_7=1\underline{4}_2$. Because the 5 already exists in the addend, it takes precedence over playing a 5 from hand to the other addend, and playing the 9 on top of the 5 already in play. Of course, if the player had both a 5 and a 7 in hand, the player could play the 5 and 7 from hand, in reverse order, as described above with respect to Table 4. In example 2 of Table 5, the player has only one card matching the cards in the subtrahend and difference of the numeric sentence in play, namely the numeric card 3. Therefore, the difference 3 in play is used, and the player may not play the 3 from hand to make $\underline{8}_9-\underline{3}_6=\underline{5}_3$. In example 3, the player has just one factor, the 8, and does not have both factors 3 and 8. Therefore, the multiplicand 8 that is already in play is used, and one of the two 8's in the player's hand may not be played to the multiplier to make $\underline{6}_8\times\underline{8}_3=4^m{}_2\underline{8}$, but one of the 8's in the player's hand may be played to the product, as shown in example 3. The fact that the player has more than one 8 in hand does not change the fact that, of the two factors in play (8 and 3) only one has the same number as a card in the player's hand. Notably, in the multiplication example in Table 5, the 4 in the product 24 that was in play was moved on top of the 2 in the product 24. This ability to move cards in play will be discussed more fully below, along with the limitations regarding moving cards in play. In the division example 4, the player has just one of the numeric cards of the divisor and quotient in hand. That is, of the divisor 9 and quotient 5, the player has only the 9. Thus, using the divisor 9 already in play to make $5^m4^m/9=\underline{6}_5$ takes precedence over using the 9 in hand to make $5^m4^m/\underline{6}_9=\underline{9}_5$. Additionally, in the division example, it should be noted that the 4 pile and 5 pile in the dividend of the numeric sentence in play were switched according to a rule for moving cards in play, as will be provided below. It should be noted that this rule is only preferred, and players may choose to ignore this rule in order to simplify game play.

As mentioned, the math game of this invention allows for moving cards already in play, but there are limitations. In addition and subtraction games, a card in the sum/minuend may be moved or repositioned within the sum/minuend, in the ways described below. Similarly, with multiplication and division games, a card in the product/dividend may be moved within the product/dividend, in the ways described below. Additionally, in certain embodiments of multiplication and division a multiplicand and/or multiplier may be repositioned to the product, and a quotient and/or divisor to the dividend, and, in certain embodiments of addition and subtraction, an addend (subtrahend and difference in subtraction) may be repositioned to the sum/minuend. When moving cards, it is preferred, although not necessary, that the entire pile be moved and the order of the cards in the pile remain unchanged. The explanation of moving cards is provided with reference to Table 6.

In addition and subtraction games, a two digit sum/minuend may become a one digit sum/minuend or vice versa. There are three ways this may occur. First, a single digit sum/minuend may be made into a two-digit sum/minuend by playing an additional card, from hand, to the left or right of that single digit. This is considered to be "moving" a card because of the change from a single to double digit. The first three rows of Table 6 provide examples for this rule. In the first row, the 1 and 4 cards played from the player's hand to the sum are played such that the 1 is played to the left of the 7 units, and the 4 is placed on top of the units 7 to create the sum 14 (the initial play of the 1 card may be considered to be "moving" the 7). In the second row, a 1 is played from hand to the left of the units 7 to create the sum 17. In the third row, a 1 is played to the left of the units 6, in the minuend, to create a minuend 16. Furthermore, a single digit sum/minuend may be made into a different single digit sum/minuend by playing a new card on top, and a double digit sum/minuend may be made into a different double digit sum/minuend by playing a card on top of the units position.

A two-digit sum/minuend may be made into a single digit sum/minuend by moving an entire pile in the sum/minuend on top of the other pile in the sum/minuend. Examples are provided in rows 4 and 5 of Table 6. In row 4, the units 5 pile in the sum is picked up and placed on top of the tens 1 pile in the sum, to change the sum 15 to the sum 5. In row 5, the minuend 17 is changed to a minuend 7 by picking up the entire units 7 pile and placing it on top of the tens 1 pile.

Thirdly, a two-digit sum/minuend may be made into a one digit sum/minuend by playing a new card on top. First, however, the tens pile is placed on top of the units pile, order of cards remaining unchanged. This rule has a catch, in that, if the new card that is played is the same number as one of the two sum/minuend digits in play, that new card may not be played. Instead, the number digit in play is repositioned on top of the other, as in the preceding rule, and the number card is not played from hand. Rows 6, 7 and 8 in Table 6 help to explain this rule. First, in row 6, the minuend tens 1 pile is placed on top of the units 4 pile, and an 8 is then played on top. The fact that the tens 1 pile was placed on top of the units pile is represented by the "m" superscript to the 1 in the representation of the "# Sentence Created." In row 7, the sum tens 1 pile is placed on top of the sum units 1 pile, and a 9 is then played on top. The example in row 8 helps to explain how a new card may not be played according to this rule if it is the same number as one of the two sum/minuend digits that was repositioned. In the example of row 8, the 7 in the player's hand may not be played on top of the pile made by placing the tens 1 pile on top of the units 7 pile; rather, the sum units 7 pile is placed on top of the sum tens 1 pile, and manipulation of the sum ends there.

For multiplication and division games, there are five ways in which cards in the product/dividend may be moved. First, a single digit product/dividend may be made into a two-digit product/dividend by playing a card to the left or right of that single digit product/dividend. Additionally, a card may first be played on top of that single digit before placing an additional card to the left or right to create a two-digit number. Referring to example 9, a 3 is played from hand as a new product units value, such that the 6 becomes a tens value. In example 10, a 3 from the player's hand is first placed on top of the product 8, and then a 2 is placed to the right of the 3 to create the product 32. Alternatively, the 2 could be placed over the 8 and the 3 placed to the left. Row 11 provides an example for division, in which a 9 is played to the right of the dividend units 4 to create the double-digit dividend 49. Furthermore, a single digit product/divided may be made into a different single digit product/dividend by simply playing a card on top.

A double-digit product/dividend may be made into a single digit number by repositioning the units or tens pile on top of the tens or units pile, respectively. In row 12, the product units 8 pile is moved on top of the tens 1 pile to satisfy the change in the numeric sentence caused by placing the 4 from the player's hand on top of the 9 at the multiplier position. In row 13, the dividend tens 6 pile is moved on top of the dividend units 3 pile to change the dividend 63 to the dividend 6.

A two-digit product/dividend may also be made to a single digit product/dividend by combining the units pile and tens pile and, thereafter, playing a new card on top of the single pile. This is treated as moving a card, and a card moved in this way is designated with a superscript "m." In row 14, the product tens 3 pile is placed on top of the product units 0 pile and, thereafter, an 8 is played from hand, on top of the combined pile. In row 15, the dividend tens 2 pile is placed on top of the dividend units 1 pile and, thereafter, a 6 is played from hand, on top of the combined pile. Notably, the card, from hand, may not be played on top of the combined pile if it is the same number as either one of two product/dividend digits in play; instead, the same number digit in play is used. This is similar to the example of row 8, in addition and subtraction. An example is provided in row 16, wherein, in the numeric sentence created, the 9 from the product 49 must be employed, rather than placing the tens pile 4 on top of the units pile 9 and, thereafter, playing the 9 from hand.

A two-digit product/dividend may also be made into a different two-digit product/dividend not only by simply playing a new card over one of the two digits, or two new cards with one over each digit, but also by first combining one pile on top of the other and then playing a card to the prior position of the pile that was repositioned. In row 17 of Table 6, the product units 1 pile is moved on top of the product tens 2 pile, and an 8 is played from hand to the units position. Again, a same number card in hand, may not be used, rather, the digit already in play takes precedence. In row 18, this aspect is shown, wherein, the product tens 2 pile in play is played on top of the product 4 units pile, but the 2, in hand, may not be played on top of the product 4 units to make $\underline{3}_6\times4=\underline{1}_2\underline{2}_4$.

Finally, product/dividend tens and units cards may be moved by reversing the position of the two piles. It will be recalled that this type of repositioning was employed in row 4 of Table 5. It is again demonstrated in row 19 and 20 of Table 6. In row 19, the product 42 is changed to the product 24 simply by switching the units and tens piles. In row 20, a wildcard, designated by the numeral 1 (represented by $wc^1$), on top of the tens dividend pile is switched with the units 2 pile to create 21 as a dividend in the number sentence being created.

In an optional embodiment, a multiplicand or multiplier in a multiplication game or a quotient or divisor in a division game may be repositioned to the product or dividend, respectively. Repositioning a numeric card from one of these positions to the product or dividend takes precedence over playing the same numeric card, from hand, to the product/dividend. A numeric card from the multiplier, multiplicand, quotient, or divisor may not be moved to replace the same numeric card in the product or dividend, and may only be moved if the player making the move has the same numeric card in hand as that which he intends to move. The player must show the same numeric card in hand by placing it on the playing surface, and it will be returned to his/her hand after play, unless it is also needed to complete the numeric sentence being created. As an exception to this rule, repositioning a 0 or 1 to the product or dividend does not require having a 0 or 1 card in hand. Rules regarding 0 and 1 cards are covered below.

The following examples help to clarify this optional rule. Example A: 4 7 8 is in hand and 3×8=24 is in play. The new numeric sentence made is $\underline{4}_3\times\underline{7}=28^m$ (multiplier 8 is moved to the product, the 8 in hand is not used). Example B: 3 4 6 is in hand and 4×7=28 is in play. The new numeric sentence made is: $\underline{4}\times\underline{6}_7=24^m$ (the 4 in hand is placed on the playing surface, the multiplicand 4 is moved to the product, and the 4 on the playing surface, instead of being returned to hand is played to the multiplicand). Because 4 is a factor, and the product units value is also a 4, the player could just leave the factor 4 in place and play the 4 from hand to the product making $4\times\underline{6}_7=2\underline{4}$. Example C: 9×4=36 is in play. The next player has 3 4 7 7 9 in hand, and makes $\underline{7}\times\underline{7}=4^m9^m$ (both factors move to product (i.e. 49 in hand is not played).

A similar optional rule applies to addition and subtraction games. Particularly, repositioning an addend to the sum to make the next numeric sentence takes precedence over playing the same number from hand to the sum, but an addend may not be repositioned to cover the same number card already in the sum. And using in any position in the sum, a card that is already in the sum, takes precedence over discarding it, and repositioning a same number addend. The addend may be moved in this way only if the player that is taking his/her turn has the same number card in hand. The player must show that number card by placing it on the playing surface, and it will be returned to his/her hand after play unless it is also need to complete the number sentence being made. When a card is moved in this way from the addend, the cards underlying the repositioned card are removed to the discard pile. For subtraction, this rule applies for repositioning cards from the subtrahend and difference to the minuend. In the following examples, a card that is repositioned is identified with an "m" superscript: 2 3 5 is in hand, and 9−5=4 is in play. The new numeric sentence made is: $5^m{}_9-\underline{3}=\underline{2}_4$ (subtrahend 5 is moved to the minuend, the player's 5 card in hand remains in hand; 3 and 2 are played from hand); 1 9 0 is in hand, and 1+4=5 is in play; the new numeric sentence made is $\underline{1}+\underline{9}_4=1^m\underline{0}_5$ (addend 1 moved directly to sum, 1 in hand played to the addend) and, because a 1 is used in the sum, and also as an addend, the player could have just left the addend 1 in place and played the 1 in hand to the sum (i.e., $1+\underline{9}_4=\underline{10}_5$); 4 9 in hand, and 9+5=14 is in play; the numeric sentence made is $\underline{4}+5=9^m{}_{1^m}$ (sum 1 moved to cover sum 4, addend 9 moved to cover the new sum pile, 4 played to addend, 9 remains in hand). In some embodiments, repositioning may be expanded to include moving a sum/minuend card except a 0 or 1 to an addend/subtrahend or difference, and a product/dividend card except a 0 or 1 to a factor/quotient or divisor.

It should be appreciated that, despite the extensive disclosure herein above regarding rules for moving cards in play, these rules might be avoided altogether by prohibiting the movement of cards in play, in order to simplify game play.

In alternative and particularly preferred embodiments of this math game, rules are provided for forcing the next player to pick up cards in play and place them in his/her hand, after the preceding player has created a true numeric sentence. In the preferred embodiment of this game, the playing of a 0 or 1 card (or a wild card played as a 0 or 1, discussed below) to particular positions within the numeric sentence framework will trigger this rule; however, it will be appreciated that this rule could be applied to the playing of any particular numeric card or alternative card (wild cards and fish cards). In addition games, the rule is triggered when a 0 or 1 is played to either addend position. In subtraction games, the rule is triggered when a 0 or 1 is played to the subtrahend or difference positions. In multiplication games, the rule is triggered when a 0 or 1 is played to the multiplier or multiplicand. In division games, the rule is triggered when a 1 is played as a divisor or quotient, or when a 0 is played as a quotient, because, in division, a 0 may not be played to the divisor. When a 0 or 1 (or wild card 0 or 1) is played to a position that triggers this rule, the 0 or 1 (or wild card designated as a 0 or 1) is picked up by the next player and placed on the playing surface in a "binary pile," so named because it contains only zeros and ones (or wild cards designated as such) that have been removed from play in this manner. If there is more than one card in the binary pile, the cards are fanned out so that the number of each card may be viewed. Cards underlying the 0 or 1, beginning in order with the top most card, are then picked up by the next player (the player taking his/her turn after the player that played the 0 or 1 and triggered this rule) and put into his/her hand, with the proviso that the player picks up cards in this manner until, at most, seven cards are in his/her hand. Any remaining underlying cards are put in the discard pile, creating an empty position in the numeric sentence framework. Table 7 provides examples for this rule, regarding the playing of zeros and ones. As an added option to this rule, it may be established that zeros and ones in the binary pile may be used again by subsequent players. A twist may be added to this rule by allowing subsequent players to play binary pile 0's, 1's, and wild cards designated as a 0 or 1 only to a sum, minuend, product, or dividend, such that the present rule is not triggered by this subsequent use. It might also be an option that two 1's or a 0 and a 1 may be played from the binary pile to make a sum/minuend 10 or 11. In multiplication and division games, both a 0 and 1 from the binary pile may be played to make a product/dividend 10. As another option, playing a 0 or 1 or a wild card designated as either a 0 or 1 from the binary pile takes precedence over playing a 0, 1, wild card 1, or wild card 0 from hand. In a twist a player may not go out of cards if leaving any cards in the binary pile. In Table 7, the first four examples are ones in which the zeros and ones, moved to the binary pile, are not used by the subsequent player, while, in the last four examples, the subsequent player uses either a zero or one that was removed to the binary pile. In the column marked "Cards in Hand After Pick-up," cards underlying the 0 or 1, which were picked up, are represented in brackets (e.g., [#]).

In example 1 of Table 7, a 1 was played to the addend position, and a 1 and 0 was played to the sum positions. Therefore, the 4 upon which the addend 1 was placed is picked up by the next player, and the 1 removed to a binary pile ("0, 1 Pile" in Table 7). This leaves a blank in the numeric sentence in play, which the player fills by playing a 3. To create the true numeric sentence, the player plays a 2 from hand to make the sum 12, and is left with the 4 in hand. Skipping now to the example in row 5, 1's were played to both addend positions, both 1 cards removed to a binary pile, and the underlying 3 and 4 picked up by the next player. The next player plays an 8 and 5, from hand, to the addend positions, plays the 3 that was picked up on top of the sum 2, and also plays a 1 from the binary pile to create the sum 13 and form a true numeric sentence. All other examples in Table 7 should be easy to follow, now that the general rule has been discussed with particularity. Notably, in the example of row 6, the 1 in the binary pile had been placed in that pile many turns previous to the playing of this particular sequence of turns. This similarly applies to the 0 in row 8. Thus, it should be appreciated that the cards in the binary pile do not have to be used right away, but are rather available for any subsequent player that may chose to use them. As an alternative, when employing this rule, the underlying cards, rather than going to the next player's hand, may be placed in the discard pile, thus creating an empty position within the numeric sentence framework.

As with many of the rules already discussed, this rule, regarding forcing subsequent players to pick up cards, is optional. Particularly alternate rules, also optional, are provided as follows. In addition and subtraction games, it may be established that 0's and 1's may be played only to the sum or minuend. In multiplication and division games, it may be established that 0's and 1's may be played only to the product or dividend. It also may be established that when a 0 or 1 is played to an addend, subtrahend, or difference a 0 or 1 may not be used in the addends/subtrahend or difference of the next number sentence, and, the 0 or 1 that was played to an addend, subtrahend or difference along with underlying cards is played over or removed to a discard pile thus creating an empty position within the numeric sentence framework (i.e., no binary pile is created for subsequent use of 0's and 1's). The same holds for the multiplicand and multiplier/quotient and divisor in multiplication/division.

For a fractions addition and subtraction game, which, as mentioned above, includes a numeric sentence framework having a specific chosen number as a denominator, the above rules are followed, and optional rules might be employed, with numeric cards being played to the numerators in the numeric sentence framework.

In multiplication and division fractions games, which employ numeric sentence frameworks having a fraction multiplicand (with the numerator being 1 and the denominator being blank or being an integer played by a preceding player), the above rules are followed except that numeric sentences are completed by playing a single numeric card other than a 0 or 1 to the denominator of the multiplicand fraction, playing one or more numeric cards to the multiplier, and/or playing a single numeric card to the product. For example, a simple multiplication and division fractions game may start with the numeric sentence 1/_____×_____=_____, and a player may play a 2 to the denominator of the multiplicand fraction, an 8 to the multiplier, and a 4 to the product (i.e., ½×8=4), and the following player may play cards over the 2, 8 and 4 of the denominator, multiplier and product, to create a new true numeric sentence. In an alternative embodiment, numeric sentences are completed by playing a fraction multiplicand and a single or double digit whole number multiplier and product. Example ⅗×_____=_____. The player may draw a second fraction card if unable to make a numeric sentence, and then may continue drawing from the whole number pile until able to make a numeric sentence using either fraction.

The addition and subtraction fractions game and the multiplication and division fractions game are also modified in their application of the rules regarding the playing of 0 and 1 numeric cards. According to this optional rule, when a 0 or 1 is played to the addend, subtrahend, or difference numerator, the 0 or 1, as the case may be, is placed in the binary pile, and the cards underlying a removed 0 or 1 are either discarded or, optionally, are added to the next player's hand. According to this optional rule, when a 0 or 1 is played as a single digit whole number multiplier or product, the next player places the 0 or 1 in the binary pile and places the underlying cards in his/her hand or following another method discards them. A 0, 1 or wild card (designated as a 0 or 1) in the 0 and 1 pile may be played to make a two digit multiplier or product. In yet another embodiment, the 0 or 1 whole number multiplier or product must be played on top of, and the next player must try to make a new numeric sentence without a 0 or 1 multiplier or product.

In algebra games, the game is started by the first player creating an incomplete number sentence by providing a variable card in any position. It is up to the next player to identify the variable within the number sentence either by playing the proper card from hand to the position of the variable card or, if the player does not have the proper numeric card, by verbally announcing the value of the variable. As an alternative rule, the player may be forced to draw cards until either the proper numeric card is found for playing to the position of the variable card or until that player has five cards in his/her hand, whichever occurs first. If this optional rule is used, once five cards are reached, the player can then announce the identity of the variable, and play can continue.

After either playing the proper card or announcing the variable, the player discards cards that were played then sets up a new incomplete number sentence with a variable, and play passes to the next player to identify the variable. A player may win by going out of cards while playing the correct numeric card that identifies the variable that completes the algebraic expression. If the player is not yet out of cards, he/she may still win on his/her set up play by going out of cards when making a complete numeric sentence without a variable.

Wild cards and fish cards have been mentioned herein. Wild cards are employed as wild cards are generally known to be employed in card games. That is, the wild card may be designated as any number desired by the player playing the wild card. When playing a wild card, a player audibly states the number (0 through 9) the wild card is to represent. However, the number that a wild card is given may not be changed in subsequent play. It remains the designated number, while it is in play. However, a wild card played as a 0 or 1 according to the pick-up rules just discussed may be replayed as a 0 or 1. As mentioned, to avoid the continued use of such a 0 or 1 under the pick-up rule, their use may be limited to the sum, minuend, product, or dividend. In some embodiments, a player may not go out of cards and win playing a wild card, but must first draw a card and then make the numeric sentence, i.e., if playing a wild card, the player may not be out of cards. A fish card is played by a player in an attempt to gain a particular numeric card desired by that player. A fish card would typically be played as a strategic move to obtain a card that allows the player to play all of the cards from his/her hand and thereby win the game. In one embodiment, a player plays the fish card by placing it on the discard pile and, thereafter, may chose any one card underlying the top cards in (a) the sum (addition), (2) the minuend (subtraction), (3) the product (multiplication), or (4) the dividend (division) and place that card in his/her hand. Alternatively, a player may play a fish card by placing it face up, thereafter drawing the top three cards from the draw pile, and choosing and selecting one of those three cards to go into his/her hand, at which time the other two cards would be removed to the discard pile. As yet another option, a player may play a fish card by placing the fish card on the discard pile and, thereafter, asking for a particular card, at which time the first person to his/her left that has the desired card must hand it over. In this embodiment, if no one has the desired card, the player may request a different card in the same fashion, and, if no player has that card, the "fish" is unsuccessful, and the fish card is placed in the discard pile, and the player that attempted to fish for a card must proceed with his/her turn. These different ways of fishing for a card are merely alternatives, and might be decided by those playing the game. A player may not go out of cards holding a fish card in hand. Rather, the player must play the fish card and select a card, as above and attempt to play that card or draw additional cards to create a true numeric sentence.

The first player to go out of cards and to not be checked with a blocking play wins the game. Blocking, as with some other rules in this game, is optional. However, when this rule is established, a player that has just played all of his/her cards to win the game may be blocked from winning the game if the next player makes a true numeric sentence by either using the cards in his/her hand or by creating a true numeric sentence after drawing up to a select number of cards from the draw pile. It is contemplated that the player attempting to block should be allowed to draw up to two cards from the draw pile to create a true numeric sentence and block the win. Thus, under such a rule, if a player plays all of his/her cards, and the next player, after optionally drawing up to two cards from the draw pile, cannot create a true numeric sentence, the win is not blocked, and the game is over. If, however, the subsequent player can block the win, the player that went out of cards draws one card from the draw pile and await his/her next turn.

Another method for winning relegates blocking to a twist The first player to go out of cards making a numeric sentence playing all cards in hand wins the game. Recall that, as an option, players may be required to start their turn with a select number of cards. As a twist the first player to go out of cards and to not be checked with a blocking play wins the game. When blocking is allowed, a player who has just made a numeric sentence and is out of cards may be blocked from winning the game if the next player can also make a numeric sentence and go out. Players may draw from the draw pile to increase the number of cards in hand if needed to make a numeric sentence.

Thus under such a rule, if a player plays all of his/her cards, and the next player cannot create a true numeric sentence and also go out, the win is not blocked, and the game is over. If however the subsequent player can go out making a numeric sentence, then the previous player who went out is blocked from a win, and the "blocking player" wins the game, unless in the rare case where the next player can do the same. In a game of two players, a blocking play would go back to a player with no cards in hand. This player may draw from the draw pile, and if he/she can make a numeric sentence going out of cards then makes a reverse block.

Tables for Providing Examples of Various Rules

TABLE 1

First Player's Turn; Creation of First True Numeric Sentence

| | Cards in Hand | # Sentence in Play | # Sentence Created | Cards Left in Hand |
|---|---|---|---|---|
| (1) | 0, 1, 3, 5, 8 | _ + _ = _ | $\underline{3} + \underline{5} = \underline{8}$ | 0, 1 |
| (2) | 1, 4, 6, 7, 9 | _ + _ = _ _ | $\underline{9} + \underline{7} = \underline{16}$ | 4 |
| (3) | 1, 4, 7, 7, 8 | _ _ − _ = _ | $\underline{14} - \underline{7} = \underline{7}$ | 8 |
| (4) | 2, 3, 5, 6, 9 | _ × _ = _ _ | $\underline{2} \times \underline{3} = \underline{6}$ | 5, 9 |
| (5) | 0, 3, 5, 6, 9 | _ × _ = _ _ | $\underline{5} \times \underline{6} = \underline{30}$ | 9 |
| (6) | 1, 3, 6, 8, 9 | _ _/_ = _ | $\underline{18}/\underline{6} = \underline{3}$ | 9 |

TABLE 2

First Player's Turn Requiring Drawing Cards to Create True Numeric Sentence

| Cards in Hand | # Sentence in Play | Cards Drawn from Draw Pile | # Sentence Created | Cards Left In Hand |
|---|---|---|---|---|
| 1, 3, 5, 7, 9 | _ + _ = _ _ | 1, 2 | $\underline{7} + \underline{2} = \underline{9}$ | 1, 1, 3, 5 |

TABLE 3

General Examples of Creating Subsequent True Numeric Sentences

| Cards in Hand | # Sentence in Play | # Sentence Created | Cards Left in Hand |
|---|---|---|---|
| 1, 2, 7, 8, 9 | 4 + 2 = 6 | $\underline{9}_4 + \underline{7}_2 = \underline{1}6$ | 2, 8 |
| 6, 8 | 14 − 5 = 9 | $14 - \underline{8}_5 = \underline{6}_9$ | none |
| 1, 2, 4, 5, 7 | 3 × 3 = 9 | $3 \times \underline{4}_3 = \underline{12}_9$ | 5, 7 |
| 5, 9 | 6 × 4 = 24 | $6 \times \underline{9}_4 = \underline{5}_2 4$ | none |
| 3, 6 | 8/2 = 4 | $\underline{6}_8/2 = \underline{3}_4$ | none |
| 3, 3, 9 | 2 × 4 = 8 | $\underline{3}_2 \times \underline{3}_4 = \underline{9}_8$ | none |

TABLE 4

Playing Cards That Essentially Reverse the Order of Cards in Play

| Cards in Hand | # Sentence in Play | # Sentence Created | Cards Left in Hand |
|---|---|---|---|
| 2, 3, 3, 7, 8 | 8 + 7 = 15 | $\underline{7}_8 + \underline{8}_7 = 15$ | 2, 3, 3 |
| 3, 4, 5, 5, 7 | 8 − 5 = 3 | $8 - \underline{3}_5 = \underline{5}_3$ | 4, 5, 7 |

TABLE 4-continued

Playing Cards That Essentially Reverse the Order of Cards in Play

| Cards in Hand | # Sentence in Play | # Sentence Created | Cards Left in Hand |
|---|---|---|---|
| 2, 9 | 2 × 9 = 18 | $\underline{9}_2 \times \underline{2}_9 = 18$ | none |
| 7, 8, 8 | 56/8 = 7 | $56/\underline{7}_8 = \underline{8}_7$ | 8 |

TABLE 5

Examples Showing the Preference for Numeric Cards Already in Play

| Cards in Hand | # Sentence in Play | # Sentence Created | Cards Left in Hand |
|---|---|---|---|
| 3, 4, 4, 5, 9 | 5 + 7 = 12 | $5 + \underline{9}_7 = 1\underline{4}_2$ | 3, 4, 5 |
| 3, 5, 5, 7, 8 | 9 − 6 = 3 | $\underline{8}_9 - \underline{5}_6 = 3$ | 3, 5, 7 |
| 6, 8, 8 | 8 × 3 = 24 | $8 \times \underline{6}_3 = 4^m{}_2\underline{8}$ | 8 |
| 6, 9 | 45/9 = 5 | $54^m/9 = \underline{6}_5$ | 9 |

TABLE 6

Examples for Moving Cards Within a Numeric Sentence

| | Cards in Hand | # Sentence in Play | # Sentence Created | Cards Left in Hand |
|---|---|---|---|---|
| (1) | 1, 4, 4, 7, 9 | 2 + 5 = 7 | $\underline{9}_2 + 5 = \underline{14}_7$ | 4, 7 |
| (2) | 1, 8, 9 | 2 + 5 = 7 | $\underline{8}_2 + \underline{9}_5 = \underline{1}7^m$ | none |
| (3) | 1, 2, 5, 8, 8 | 6 − 4 = 2 | $\underline{16}^m - \underline{8}_4 = \underline{8}_2$ | 2, 5 |
| (4) | 2, 3, 5, 7, 7 | 8 + 7 = 15 | $\underline{2}_8 + \underline{3}_7 = 5^m{}_1$ | 5, 7, 7 |
| (5) | 2, 5, 7 | 17 − 9 = 8 | $7^m{}_1 - \underline{5}_9 = \underline{2}_8$ | 7 |
| (6) | 2, 2, 5, 6, 8 | 14 − 5 = 9 | $\underline{8}_1{}^m - \underline{6}_5 = \underline{2}_9$ | 2, 5 |
| (7) | 3, 3, 5, 7, 9 | 6 + 5 = 11 | $6 + \underline{3}_5 = \underline{9}_1 m$ | 3, 5, 7 |
| (8) | 3, 4, 4, 7, 8 | 9 + 8 = 17 | $\underline{3}_9 + \underline{4}_8 = 7^m{}_1$ | 4, 7, 8 |
| (9) | 3, 7, 9 | 2 × 3 = 6 | $\underline{9}_2 \times \underline{7}_3 = 6^m\underline{3}$ | none |
| (10) | 2, 3, 8, 9 | 2 × 4 = 8 | $\underline{8}_2 \times 4 = \underline{3}_8\underline{2}$ | 9 |
| (11) | 7, 7, 9 | 4/2 = 2 | $4^m\underline{9}/\underline{7}_2 = \underline{7}_2$ | none |
| (12) | 4 | 2 × 9 = 18 | $2 \times \underline{4}_9 = \underline{8}^m{}_1$ | none |
| (13) | 2, 3, 8 | 63/9 = 7 | $6^m{}_3/\underline{2}_9 = \underline{3}_7$ | 8 |
| (14) | 2, 4, 8, 9 | 5 × 6 = 30 | $\underline{2}_5 \times \underline{4}_6 = \underline{8}_3{}^m$ | 9 |
| (15) | 2, 6 | 21/3 = 7 | $\underline{6}_2{}^m/3 = \underline{2}_7$ | none |
| (16) | 3, 3, 9 | 7 × 7 = 49 | $\underline{3}_7 \times \underline{3}_7 = 9^m{}_4$ | 9 |
| (17) | 6, 8, 9 | 3 × 7 = 21 | $3 \times \underline{6}_7 = 1^m{}_2\underline{8}$ | 9 |
| (18) | 1, 2, 3 | 6 × 4 = 24 | $\underline{3}_6 \times 4 = 12^m{}_4$ | 2 |
| (19) | 4 | 6 × 7 = 42 | $6 \times \underline{4}_7 = 2^m4^m$ | none |
| (20) | 7 | (wc1)2/4 = 3 | $2^m(wc1)^m/\underline{7}_4 = 3$ | none |

TABLE 7

Examples for Picking Up Cards Underlying a 0 or 1 Played to Certain Positions
(As an alternative, the game may be played where the underlying cards are discarded)

| | Cards in Hand | # Sentence in Play | Applying the 0 & 1 Rule | 0, 1 Pile | Cards in Hand After Pick-up | # Sentence Made | Cards Left |
|---|---|---|---|---|---|---|---|
| (1) | 2, 3 | $1_4 + 9_3 = 10_7$ | $_ + 9_3 = 10_7$ | 1 | 2, 3, [4] | $\underline{3} + 9_3 = 12_0$ | 4 |
| (2) | 4, 7 | $1_9 - 0_2 = 1_7$ | $1_9 - _ = _$ | 0, 1 | [2], 4, 7, [7] | $1_9\underline{4} - \underline{7} = \underline{7}$ | 2 |
| (3) | 2, 4, 8 | $1_2 \times 5_3 = 5_6$ | $_ \times 5_3 = 5_6$ | 1 | 2, [2], 4, 8 | $\underline{2} \times \underline{4}_5 = \underline{8}_5$ | 2 |
| (4) | 4, 5, 8 | $1_3 \times 0_3 = 0_9$ | $_ \times _ = 0_9$ | 0, 1 | [3, 3], 4, 5, 8 | $\underline{5} \times \underline{8} = \underline{4}0_9$ | 3, 3 |
| (5) | 5, 8 | $1_3 + 1_4 = 2_7$ | $_ + _ = 2_7$ | 1, 1 | [3, 4], 5, 8 | $\underline{8} + \underline{5} = 1\underline{3}_2$ | 4 |
| (6) | 4 | $8_9 - 0_2 = 8_7$ | $8_9 - _ = 8_7$ | 0, 1 | 4, [2] | $10_8 - \underline{2} = 8_7$ | 4 |
| (7) | 3, 6, 8 | $1_2 \times 7_3 = 7_6$ | $_ \times 7_3 = 7_6$ | 1 | [2], 3, 6, 8 | $\underline{3} \times \underline{6}_7 = 1\underline{8}_7$ | 2 |
| (8) | 5 | $24_6/8_2 = 3$ | $24_6/8_2 = 3$ | 0 | 5 | $4^m{}_2 0/8_2 = \underline{5}_3$ | none |

While a full and complete description of the preferred embodiment of this invention has been set forth in accordance with the dictates of the patent statutes, it should be understood this invention is not limited to or by any particular preferred embodiment, and modifications can be resorted to without departing from the scope of this invention as established by the appended claims.

What is claimed is:

1. A method for playing a mathematics game comprising the steps of:

providing playing cards including a plurality of numeric cards, at least one operational card, and at least one equal sign card;

constructing a numeric sentence framework to be employed for the entirety of the mathematics game, the numeric sentence framework including at least one operational card and only one equal sign card defining positions to which numeric cards are played to create true numeric sentences during the playing of the mathematics game;

dealing a select number of the plurality of numeric cards to a select number of players to provide each player with a hand of numeric cards;

creating a first true numeric sentence by playing into the numeric sentence framework created in said step of constructing a numeric sentence framework at least one or more of the numeric cards in a player's; and after said step of creating a first true numeric sentence, each of the select number of players takes turns creating a true numeric sentence by playing one or more numeric cards from their respective hand into the true numeric sentence left by the preceding player, wherein the numeric sentence framework is structured such that only one true numeric sentence exists after each player's turn.

2. The method for playing a math game according to claim 1, wherein not all of the plurality of numeric cards are dealt in said step of dealing, such that a remainder of numeric cards is provided, and a draw pile is created from the remainder of numeric cards.

3. The method for playing a math game according to claim 1, wherein stacks of numeric cards are created within the numeric sentence framework as each of the select number of players plays numeric cards on top of numeric cards played by preceding players, and the number of numeric cards in a player's hand may be increased, on that player's turn, by drawing one or more numeric cards from the draw pile.

4. The method for playing a math game according to claim 3, wherein, if the draw pile is exhausted, all but the top cards on the stacks of numeric cards within the numeric sentence framework are gathered and reshuffled to create a new draw pile, while the top cards remain in their respective positions within the numeric sentence framework.

5. The method for playing a math game according to claim 3, wherein, when a 0 or 1 numeric card is played at a preselected position within the numeric sentence framework, the stack of numeric cards under the 0 or 1 numeric card are handled through a step selected from the group consisting of (a) placing the numeric cards in the next player's hand and (b) removing the numeric cards to a discard pile, and the 0 or 1 numeric card thus played is removed from the numeric sentence framework.

6. The method for playing a math game according to claim 3, further comprising ending the game when a player's hand has no numeric cards remaining.

7. The method for playing a math game according to claim 3, wherein a player wins the game if the player creates a true numeric sentence using all the numeric cards in the player's hand, with the proviso that the game is not won if the next player can create a subsequent true numeric sentence by playing at least one or more numeric cards from said next player's hand, wherein the numeric cards in said next player's hand may be increased by drawing up to a select number of numeric cards from the draw pile.

8. The method for playing a math game according to claim 3, wherein the numeric sentence framework is an addition equation framework according to:

_____+_____=_____, wherein "+" represents the at least one operational card and is a plus sign, "=" represents the equal sign card, and the multiple blank lines define positions for a numeric card, such that the addends and sum of the addition equation framework are limited to single digit numbers.

9. The method for playing a math game according to claim 3, wherein the numeric sentence framework is a subtraction equation framework according to:

_____–_____=_____, wherein "–" represents the at least one operational card and is a minus sign, "=" represents the equal sign card, and the multiple blank lines define positions for a numeric card, such that the minuend, subtrahend, and difference of the subtraction equation framework are limited to single digit numbers.

10. The method for playing a math game according to claim 3, wherein the numeric sentence framework is an addition equation framework according to:

_____+_____=_____ _____, wherein "+" represents the at least one operational card and is a plus sign, "=" represents the equal sign card, and the multiple blank lines define positions for a numeric card, such that the addends of the addition equation framework are limited to single digit numbers and the sum may be a single or double-digit number.

11. The method for playing a math game according to claim 3, wherein the numeric sentence framework is a subtraction equation framework according to:

_____ _____–_____=_____, wherein "–" represents the at least one operational card and is a minus sign, "=" represents the equal sign card, and the multiple blank lines define positions for a numeric card, such that the subtrahend and difference of the subtraction equation framework are limited to single digit numbers and the minuend may be a single or double digit number.

12. The method for playing a math game according to claim 3, wherein the numeric sentence framework is a division equation framework according to:

_____ _____/_____=_____, wherein "/" represents the at least one operational card and is a division sign, "=" represents the equal sign card, and the multiple blank lines define positions for a numeric card, such that the divisor and quotient of the division equation framework are limited to single digit numbers and the dividend may be a single or double digit number.

13. The method for playing a math game according to claim 3, wherein the numeric sentence framework is a multiplication equation framework according to:

_____×_____=_____ _____, wherein "×" represents the at least one operational card and is a multiplication sign, "=" represents the equal sign card, and the multiple blank lines define positions for a numeric card, such that the multiplicand and multiplier of the multiplication equation framework are limited to single digit numbers and the product may be a single or double digit number.

14. The method for playing a math game according to claim 1, wherein the playing cards further include at least one variable card, and the numeric sentence framework is a framework for an algebraic equation and contains a variable card.

15. The method of claim 1, wherein, as each player takes turns creating a true numeric sentence, they may selectively reposition one or more cards left by the preceding player by moving the card or cards to different locations within the numeric sentence framework.

16. A method for playing a mathematics game comprising the steps of:

providing playing cards including a plurality of numeric cards, at least one operational card, and at least one equal sign card;

constructing a numeric sentence framework;

dealing a select number of the plurality of numeric cards to a select number of players to provide each player with a hand of numeric cards;

taking turns creating true numeric sentences by having a first player of said select number of players create a first true numeric sentence by playing into the numeric sentence framework at least one or more of the numeric cards in that first player's hand, wherein, after said step of creating a first true numeric sentence, each of the select number of players takes turns creating a true numeric sentence by playing at least one or more numeric cards from their respective hand into the numeric sentence framework, on top of one or more numeric cards in the true numeric sentence left by the preceding player, such that stacks of numeric cards are created within the numeric sentence framework as each of the select number of players plays numeric cards on top of numeric cards played by preceding players; wherein, when a 0 or 1 numeric card is played at a preselected position within the numeric sentence framework, the stack of numeric cards under the 0 or 1 numeric card are handled through a step selected from the group consisting of (a) placing the numeric cards in the next player's hand and (b) removing the numeric cards to a discard pile, and the 0 or 1 numeric card thus played is removed from the numeric sentence framework.

17. The method for playing a mathematics game according to claim 16, wherein the numeric sentence framework is an addition equation framework according to the following select group:

_____+_____=_____, and

_____+_____=_____ _____, wherein "+" represents the at least one operational card and is a plus sign, "=" represents the at least one equal sign card, and the multiple blank lines represent placement positions for a numeric card played from a player's hand, such that the addends of the addition equation framework are limited to single digit numbers, and the sum may be selected to be either a single or a double digit number and may further be changed between a single and a double digit number as necessary to create a desired true numeric sentence, and said preselected position is either of the addend positions within the addition equation framework.

18. The method for playing a mathematics game according to claim 16, wherein the numeric sentence framework is a subtraction equation framework selected from the group consisting of:

_____–_____=_____, and

_____ _____–_____=_____ wherein "–" represents the at least one operational card and is a minus sign, "=" represents the at least one equal sign card, and the multiple blank lines represent placement positions for a numeric card played from a player's hand, such that the subtrahend and difference of the subtraction equation framework are limited to single digit numbers, and the minuend may be selected from either a single or a double digit number and may further be changed between a single and a double digit number as necessary to create a desired true numeric sentence, and said preselected position is either the subtrahend position or difference position within the subtraction equation framework.

19. The method for playing a mathematics game according to claim 16, wherein the numeric sentence framework is a multiplication equation framework selected from the group consisting of:

_____×_____=_____ _____, wherein "×" represents the at least one operational card and is a multiplication sign, "=" represents the at least one equal sign card, and the multiple blank lines represent placement positions for a numeric card played from a player's hand, such that the multiplicand and multiplier of the multiplication equation framework are limited to single digit numbers and the product may be a single or double digit number and may further be changed between a single and a double digit number as necessary to create a desired true numeric sentence, and said preselected position is either the multiplier position or multiplicand position within the multiplication equation framework.

20. The method for playing a mathematics game according to claim 16, wherein the numeric sentence framework is a multiplication equation framework selected from the group consisting of:

_____ _____/_____=_____, wherein "/" represents the at least one operational card and is a division sign, "=" represents the at least one equal sign card, and the multiple blank lines represent placement positions for a numeric card played from a player's hand, such that the divisor and quotient of the division equation framework are limited to single digit numbers and the dividend may be a single or double digit number and may further be changed between a single and a double digit number as necessary to create a desired true numeric sentence, and said step of placing a stack of cards under 0 or 1 into the next player's hand or removing the numeric cards to a discard pile is triggered when a 1 is played to either the divisor or quotient positions or when a 0 is played to the quotient position of the division equation framework.

* * * * *

UNITED STATES PATENT AND TRADEMARK OFFICE

CERTIFICATE OF CORRECTION

PATENT NO. : 7,367,564 B2
APPLICATION NO. : 11/036566
DATED : May 6, 2008
INVENTOR(S) : Richard Latell It is certified that error appears in the above-identified patent and that said Letters Patent is hereby corrected as shown below:

Column 19, line 27 (Claim 1, line 19) after the word "player's" add the word --hand--

Signed and Sealed this

Eighth Day of July, 2008

JON W. DUDAS
*Director of the United States Patent and Trademark Office*